United States Patent [19]

Rigden

[11] 4,352,043

[45] Sep. 28, 1982

[54] CATHODOLUMINESCENT LIGHT SOURCES AND ELECTRIC LIGHTING ARRANGEMENTS INCLUDING SUCH SOURCES

[75] Inventor: Sydney A. R. Rigden, Hemel Hempstead, England

[73] Assignee: The General Electric Company Limited, London, England

[21] Appl. No.: 232,169

[22] Filed: Feb. 6, 1981

[30] Foreign Application Priority Data

Feb. 27, 1980 [GB] United Kingdom ..... 8006549
Jun. 4, 1980 [GB] United Kingdom ..... 8018285

[51] Int. Cl.[3] ..... H05B 43/00; H01J 63/06

[52] U.S. Cl. ..... 315/1; 313/293; 313/396; 313/448; 313/495; 315/58; 315/205; 315/349

[58] Field of Search ..... 313/293, 308, 364, 396, 313/441, 447–450, 483, 495; 315/1, 58, 71, 200 R, 205, 349

[56] References Cited

U.S. PATENT DOCUMENTS

| | | | |
|---|---|---|---|
| 2,907,909 | 10/1959 | Kazuk | 313/483 |
| 3,299,305 | 1/1967 | Kreuder | 313/495 |
| 3,377,492 | 4/1968 | Oess | 313/396 |
| 3,746,909 | 7/1973 | Runtzel et al. | 313/396 |
| 3,917,968 | 11/1975 | Di Benedetto et al. | 313/450 X |

FOREIGN PATENT DOCUMENTS

| | | |
|---|---|---|
| 2389226 | 11/1978 | France . |
| 749448 | 5/1956 | United Kingdom . |

*Primary Examiner*—Eugene R. La Roche
*Attorney, Agent, or Firm*—Kirschstein, Kirschstein, Ottinger & Cobrin

[57] ABSTRACT

A cathodoluminescent lamp for use for general lighting service includes an anode constituted by an electrically conducting coating, which may be partly internally reflective, on the interior surface of the bulb wall, a phosphor coating over the whole of the bulb wall interior, a dome-shaped metal mesh grid located near the junction of the bulb with the envelope neck and supported on a hollow metal cylinder, and an electron emissive cathode mounted within the grid/cylinder assembly. The cathode may be a "wreath" filament or indirectly heated disc located near the grid, or a linear filament located near the open end of the cylinder remote from the grid. In the latter case a metal disc, connected to the negative lead to the cathode, is located near the open end of the cylinder, to repel electrons emerging therefrom. A circuit, which may be incorporated in the lampholder, converts the supply to unidirectional operating voltages applied to the anode, grid and cathode.

10 Claims, 4 Drawing Figures

Figure 1:
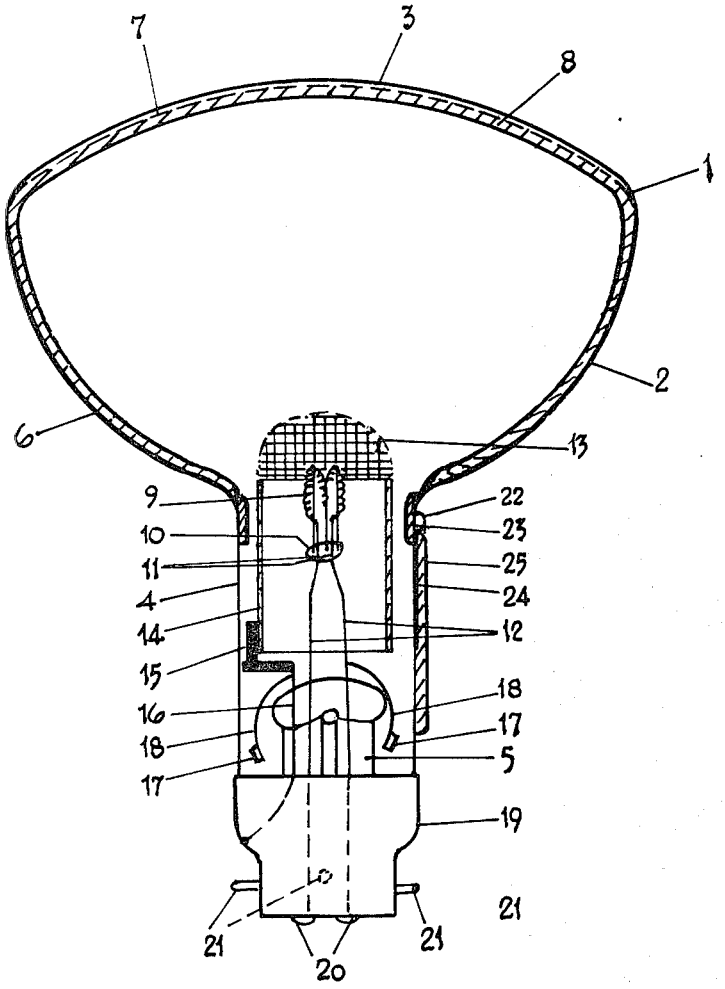

CATHODOLUMINESCENT LIGHT SOURCES AND ELECTRIC LIGHTING ARRANGEMENTS INCLUDING SUCH SOURCES

This invention relates to cathodoluminescent light sources and to electric lighting arrangements including such sources.

It is an object of the invention to provide a cathodoluminescent light source in the form of a lamp which is suitable for use for general lighting purposes.

According to the invention a cathodoluminescent light source consists of an electric lamp which includes an evacuated bulbous glass envelope with an integral glass neck terminated by a cap, an anode constituted by an electrically conductive coating on at least part of the interior surface of the bulb wall, such that at least part of the bulb wall is light transmissive, a layer of phosphor on the whole of the interior of the bulb wall and overlying the said anode coating, which phosphor is excitable to luminescence by electron bombardment, a dome-shaped grid located within the bulb adjacent to the junction between the bulb and neck of the envelope, and supported by a hollow metal cylinder disposed coaxially within the envelope neck, an electron emissive cathode mounted within the assembly of the grid and its supporting cylinder, which cathode is so shaped, and/or so located within the said grid assembly, that the electrons emitted from the cathode in operation of the lamp are substantially uniformly distributed over the whole of the surface of the grid on which they impinge, and electrically conducting leads connecting said anode, grid and cathode to respective contacts, the grid and cathode contacts being constituted by or carried by the said cap and the anode contact being located on the exterior of the envelope neck, which contacts are adapted to be connected to a circuit arrangement for operation of the lamp from a source of electric current supply.

The anode preferably covers the whole of the interior surface of the bulb wall and may consist of a known type of light transmissive electrically conducting coating formed, for example, of tin oxide and/or indium oxide. Alternatively, part of the bulb may be provided with an internally reflective metal coating which also serves as at least part of the anode, the remainder of the bulb either being free from any conductive coating or, preferably, having a light transmissive conducting coating to provide continuity of the anode over the whole of the bulb wall.

The presence of the dome-shaped grid, together with the provision, within the grid assembly, of an electron emissive cathode so shaped and/or located that the elctrons emitted from the cathode in operation of the lamp are substantially uniformly distributed over the surface of the grid on which they impinge, promotes substantially uniform distribution of the bombarding electrons over the whole of the phosphor-coated bulb surface, thus ensuring substantially uniform light output from the whole of the light transmissive surface area of the bulb. The grid is preferably formed of metal mesh, for example of nickel or stainless steel. The cylindrical grid support member may be formed of any gas-free metal conventionally used for a similar purpose in, for example, thermionic valves or cathode ray tubes, such as a nickel-iron alloy; however, the cylinder is advantageously formed of a metal having gettering properties, such as titanium, tantalum, or zirconium. If desired, a second metal cylinder may be mounted concentrically around the grid-supporting cylinder, and this second cylinder may also support a second grid, for example in the form of a second metal mesh dome, or a plate with a single aperture, such plate being located within the mesh grid. Such a double cylinder or double grid arrangement may be required, in some cases, for modifying the electron distribution and the electrical characteristics of the lamp.

In a first form of lamp in accordance with the invention, the cathode is of effectively circular form and is located coaxially within the grid assembly so that the electron-emissive part thereof lies in the region of the junction between the grid and its supporting cylinder. The term "effectively circular" is to be understood to mean that the cathode is so shaped and arranged that, in plan view as observed from the center of the bulb interior, it has the appearance of a circle or a nearly closed circle. The cathode may be of the directly heated type, preferably of filamentary form, consisting of a single coil or coiled coil, of refractory metal wire, incorporating electron emissive material; the filament is of "wreath" form, that is to say the coil is effectively circular, as defined above, forming a nearly closed circle: this effect can be achieved by a circular or zig-zag form of mounting, the zig-zag arrangement enabling a greater length of coil to be used. Alternatively, the cathode may be of the indirectly heated type, suitably consisting of a hollow metal cylinder capped with a metal disc which is coated externally with electron emissive material, with a heating coil located within and insulated from the cylinder.

The provision of an effectively circular cathode, located adjacent to the grid, as described above, ensures that the electrons emitted from the cathode in operation of the lamp are substantially uniformly distributed over the surface of the grid. However, in some cases it is desirable to employ a filamentary cathode in the form of a linear coil of wire, in particular because linear coil filaments are more readily mass produced by automatic means than "wreath" filaments.

In a second form of lamp in accordance with the invention, therefore, the cathode consists of a linear wire coil filament incorporating electron emissive material, the coil being disposed orthogonally to the longitudinal axis of the assembly of the grid and its supporting cylinder, and the cathode is located within the grid supporting cylinder in a position nearer to the open end of the cylinder remote from the grid than to the end thereof on which the grid is supported. The cathode may be a single coil or coiled coil of refractory metal wire, and is supported on two or more wires so that it lies straight.

As a result of the positioning of the linear cathode within the grid support cylinder, a large proportion of the electrons emitted by the filament in operation of the lamp are initially attracted by the cylinder, which is maintained at a positive potential. The electrons are thus diffused in all directions around the filament and therefore, on impinging on the grid, are distributed substantially uniformly over the interior surface thereof.

Since the linear cathode is located relatively near to the open end of the grid supporting cylinder remote from the grid, there is a tendency for some of the emitted electrons to flow out from the said open end of the cylinder and to be attracted to the glass neck of the envelope, which is positively charged in operation, thus heating the neck and possibly causing it to crack. In order to prevent the occurrence of this effect, it is preferred, in an additional feature of the said second form of the lamp of the invention, to provide a metal disc of substantially the same diameter as the cylinder, located close to, and either inside or outside, but out of contact with, the said open end of the cylinder and disposed coaxially with the cylinder, and connected to that lead to the cathode to which a negative potential will be applied in operation, the disc having a central aperture permitting the passage of the cathode leads therethrough. With this arrangement, a negative potential will be applied to the disc in operation, which potential will be of sufficient magnitude to repel electrons and thus prevent them from flowing out from the open end of the cylinder.

In either of the above-described forms of lamp, the wires supporting a filamentary cathode may be sealed into or through a glass bead in conventional manner. The cathode assembly so formed, or a cylindrical indirectly heated cathode, and the grid cylinder or cylinders may be supported on wires sealed into the closure of the neck of the lamp envelope, which closure is suitably a pinched foot tube of the form conventionally used in the manufacture of incandescent lamps, and current conducting leads from contacts on the lamp cap to the cathode and grid may be constituted by, or may incorporate, such support wires. A metal disc incorporated in the aforesaid second form of lamp, for repelling electrons emerging from the open end of the grid supporting cylinder, may also be supported by a wire sealed into the neck closure. The lead to the anode is located along the exterior of the envelope neck, being connected to the anode by an end of the lead wire sealed through the envelope wall, and said lead extending to a contact provided on the exterior of the neck.

We have found that glasses of the type generally used for incandescent lamp envelopes, such as conventional soda-lime glasses, may be unsuitable for use for the envelope of a lamp in accordance with the invention, in particular because such glasses permit the transmission of X-rays generated by the electron bombardment of the envelope. The envelope is therefore preferably formed of an X-ray inhibiting glass, for example a lead glass.

The invention further provides an electric lighting arrangement consisting of a lamp of either of the forms described above, and a circuit arrangement for operating said lamp from a source of electric current supply, which circuit arrangement includes means for converting the supply voltage to unidirectional operating potentials of required magnitudes for application respectively to the anode, cathode and grid of the lamp.

For operation of the lamp, a high potential, suitably in the range of 5 to 15 kilovolts, is required to be applied to the anode: the circuit arrangement, for operation from a standard mains supply, therefore includes step-up means, suitably comprising a high frequency oscillator, a transformer, and a voltage multiplying system. The circuit will also include current limiting means for applying a low voltage, usually between 6 and 40 volts, which is negative with respect to the grid potential, across the cathode, and usually also means for reducing the supply voltage for the application of a suitable potential to the grid. The grid potential may be from 40 to 250 volts, the magnitude of the grid potential required depending upon the configuration of the cathode-grid assembly: thus the greater the spacing apart of the cathode and grid, the greater is the grid potential required. If, as is usual, the lamp is to be operated from an alternating current supply, rectification will of course be required, and where an oscillator is employed as part of the step-up arrangement for providing the anode potential, further rectifying means will be required to be inserted between the transformer and the connection to the anode.

Miniaturisation of electronic circuitry makes it possible to provide a compact package consisting of the lamp and its operating circuit arrangement. Thus the circuit arrangement may be contained within a housing which is detachably mounted on the lamp cap and which is insertable into a lamp-holder, the circuit-housing assembly incorporating contacts arranged to co-operate with the contacts on the lamp cap and/or neck, and the housing also carrying external contacts for connecting the circuit arrangement to the supply by co-operation with contacts in a lampholder. Alternatively the circuit arrangement may be incorporated in or associated with a lampholder which includes a socket having contacts arranged to co-operate with the contacts on the lamp for connection of the circuit thereto.

A lamp in accordance with the invention has the additional advantage that it can be of a robust and relatively simple construction which is not critical dimensionally.

Figure 2:
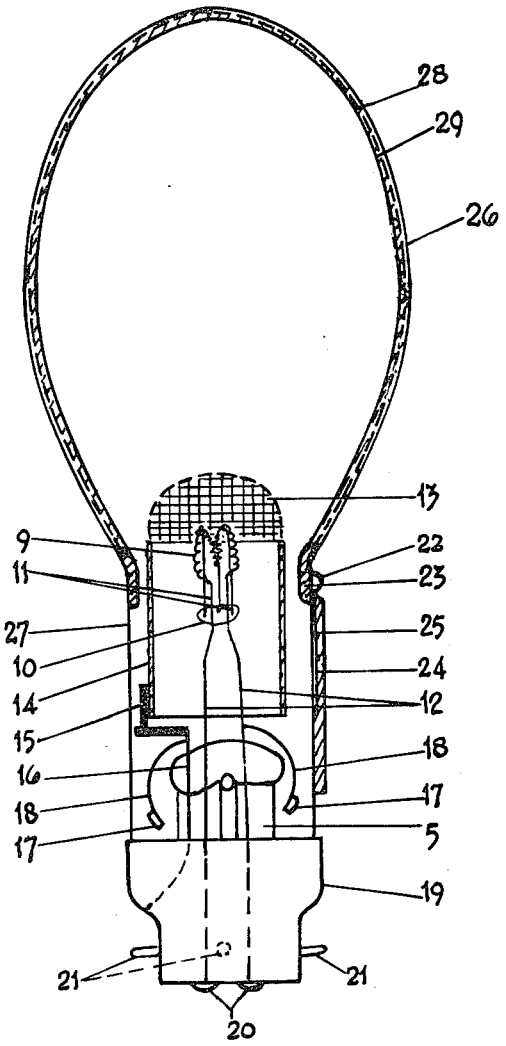
Figure 3:
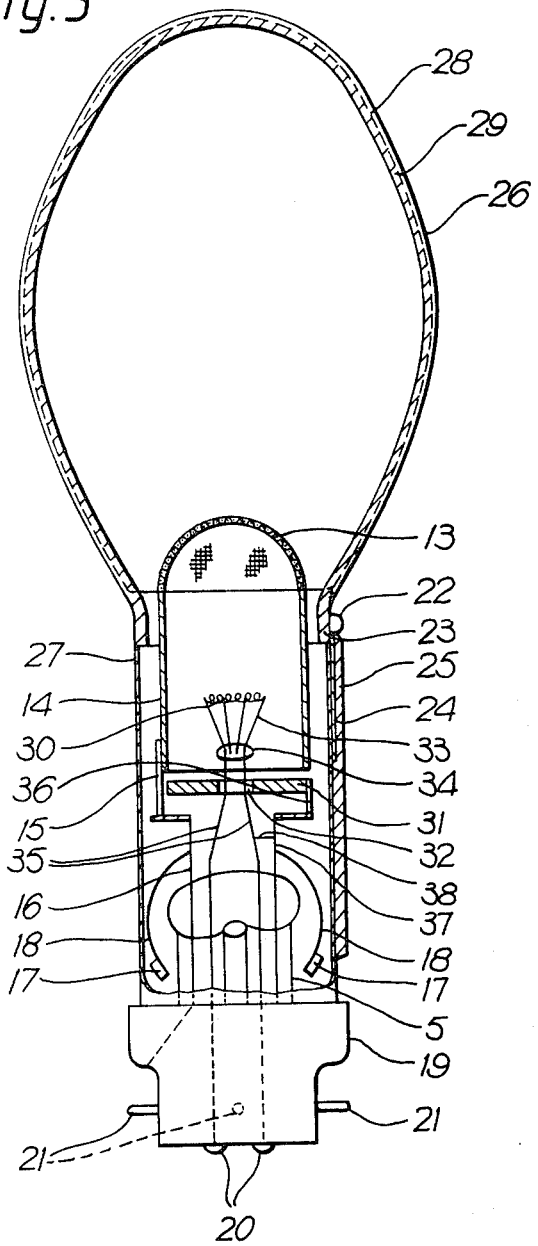

Some specific lamps in accordance with the invention, and the method of operation thereof, will now be described by way of example with reference to the accompanying diagrammatic drawings, in which FIG. 1 shows, in part-sectional elevation, a reflector lamp of the first form described above, FIG. 2 shows, also in part-sectional elevation, a lamp of the said first form for general lighting service, FIG. 3 is a part-sectional elevation of a general lighting service lamp of the second form described above, and FIG. 4 is a schematic representation of a circuit arrangement suitable for the operation of a lamp of any of the forms shown in FIGS. 1, 2 and 3.

Like parts in FIGS. 1, 2 and 3 are indicated by the same reference numerals.

The lamp shown in FIG. 1 comprises an evacuated envelope 1 formed of lead glass, consisting of a bulb 2 of substantially paraboloid shape, with a slightly curved front face 3, and an integral neck 4 in which an electron gun assembly is mounted, and which is closed in conventional manner by a pinched glass foot tube 5. The paraboloid rear portion 2 of the bulb wall is internally coated with aluminium, 6, and the front face 3 is internally coated with a transparent film 7 of conducting material, suitably tin oxide and/or indium oxide: these coatings together constitute the anode, the aluminium coating also serving as a reflector, and are overlaid by a layer of phosphor 8, which may be of any known electron-responsive type. The thicknesses of the coatings are exaggerated in the drawing.

The electron gun assembly includes a cathode and a grid. The cathode is in the form of a wreath type filament 9, composed of a single coil of tungsten wire activated with one or more of the oxides of barium, strontium and calcium, mounted in zig-zag manner on five support wires sealed into a glass bead 10, the wires 11 to which the ends of the coil are attached being extended through the glass bead and joined to nickel wires 12 which are sealed through the foot tube 5 and which constitute supports for, and conducting leads to, the cathode. The grid consists of a dome-shaped structure 13 of nickel wire mesh, supported on a titanium cylinder 14 which is carried by a nickel bracket 15 attached to a nickel lead wire 16 sealed through the foot tube. Barium/aluminium getter rings 17 are supported by wires 18 attached to the lead wires to the cathode and grid.

The closed end of the bulb neck is cemented into a brass cap 19, in known manner. The cap carries contacts 20, insulated from the brass, to which the cathode leads 12 are connected, and the grid lead 16 is connected to the cap itself, which thus constitutes the grid contact. The cap is provided with locating pins 21, preferably three in number to ensure correct orientation of the lamp in a lampholder for connection of the lamp contacts to the operating circuit.

Connection to the anode 6, 7 is made by means of a wire 22 of metal having a suitable thermal expansion match to the envelope glass, which wire is sealed through the envelope at the junction of the neck and the aluminised portion of the bulb, and a coating of carbon 23 is applied to the interior of the neck-bulb junction region, covering the internal end of the wire 22 and part of the aluminium coating, to ensure reliability of the anode connection. The wire 22 extends along the exterior of the neck as shown at 24, and is covered by a strip coating of carbon 25 which constitutes the anode contact.

The envelope of the general service lamp shown in FIG. 2 consists of an evacuated bulb 26 of oblate spheroid shape with an integral neck 27, formed of lead glass, the neck being closed by a pinched glass foot tube 5 and surmounted by a brass cap 19. The whole of the internal surface of the bulb has a transparent film coating 28 of conducting material forming the anode, covered with a layer of electron-responsive phosphor 29. If desired, the phosphor may be coated with an aluminium film, in known manner, to enhance the light output of the lamp. The arrangement of cathode, grid, and conducting leads and contacts for the anode, cathode and grid is similar to that employed in the reflector lamp described above with reference to FIG. 1, and getters and locating pins as described with reference to FIG. 1 are also provided.

The lamp shown in FIG. 3 is similar to that shown in FIG. 2 in respect of its outward form, consisting of an evacuated oblate spheroid lead glass bulb 26 and integral neck 27, with a pinched glass foot tube closure 5 and a brass cap 19, the whole of the internal surface of the bulb having an anode coating consisting of a film 28 of transparent conducting material, overlaid by a layer of electron-responsive phosphor 29. The electron gun assembly, mounted within the neck 27, includes a dome-shaped grid 13 of nickel wire mesh, supported on a titanium cylinder 14, a cathode 30 in the form of a straight single coil of tungsten wire incorporating electron emissive material, which is located in the lower part of the cylinder 14, and a titanium disc 31 which has a central aperture 32 and which is located immediately below the open lower end of the cylinder 14.

The cathode coil 30 is mounted on four support wires 33 sealed into a glass bead 34, the wires to which the ends of the coil are attached being extended through the aperture 32 in the disc 31 and joined to nickel wires 35 which are sealed through the foot tube 5 and which constitute supports for, and conducting leads to, the cathode, being connected to contacts 20 carried by and insulated from the lamp cap 19. The disc 31 is supported by a nickel bracket 36 and nickel wire 37, the latter also being sealed into the foot tube; the wire 37 is connected to the negative lead to the cathode, as shown at 38.

The conducting leads and contacts for the grid and the anode, and the getters and locating pins, incorporated in the lamp of FIG. 3, are similar to those described above with reference to FIG. 1.

An electron gun assembly of the form described with reference to FIG. 3 may also be incorporated in a reflector lamp which in other respects is of the form shown in FIG. 1.

For operation, a lamp of any of the forms shown in FIGS. 1, 2 and 3 is inserted into a lampholder, or a housing insertable into a lampholder, in which a circuit arrangement for operating the lamp from an electric current supply is mounted, and which includes a socket formed of insulating material extending along substantially the whole length of the lamp neck, so as to cover the anode lead wire 22 and the carbon strip 25 on the exterior of the neck. The socket carries internal contacts arranged to co-operate with the said carbon strip, the contacts 20 and the cap 19, for connection of the anode, cathode and grid respectively to the operating circuit.

Figure 4:
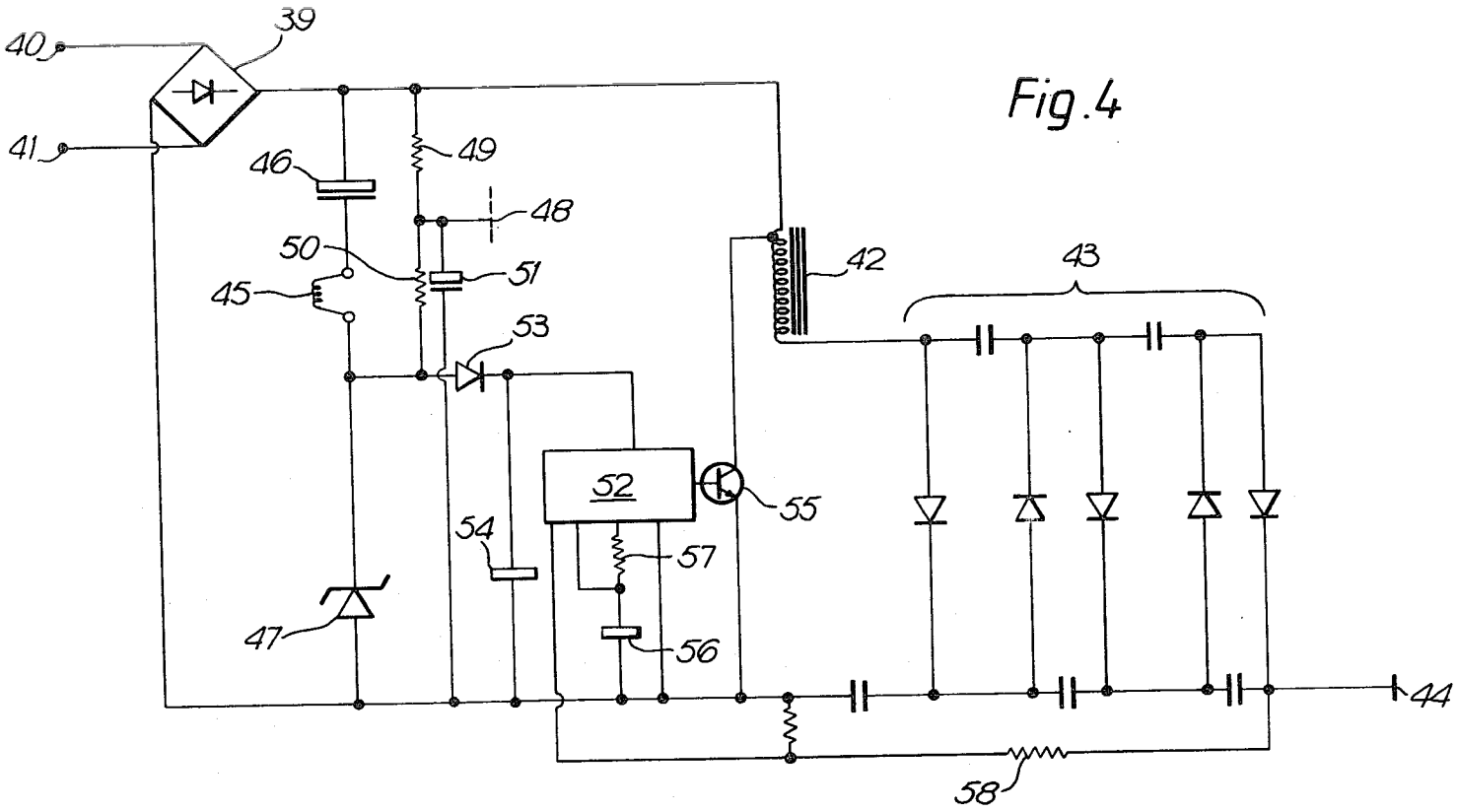

FIG. 4 shows, by way of example only, one form of circuit arrangement which can be employed for operating a lamp of any of the forms described above with reference to FIGS. 1, 2 and 3, from a 240 volts alternating current supply. This circuit arrangement is made up of conventional components, and includes essentially a full wave rectifier 39, connected across the supply terminals 40 and 41, a step-up transformer 42 and voltage multiplying arrangement 43 for applying the requisite potential in the range of 5 to 15 kilovolts to the lamp anode 44, and subsidiary circuits for applying suitable potentials to the lamp cathode and grid.

A current limiting arrangement is provided for reducing the current from the rectifier 39 to the lamp cathode 45, this arrangement including a smoothing condenser 46 and a zener diode 47 for maintaining the cathode potential constant, and negative with respect to the grid potential, suitably at 10 volts. The connection to the lamp grid 48 is in a line in parallel with the cathode circuit; the grid potential is reduced, suitably to 100 volts in the case of a lamp of either of the forms shown in FIGS. 1 and 2 or to 150 volts in the case of a lamp of the form shown in FIG. 3, by resistors 49 and 50, and is smoothed by condenser 51.

The arrangement for supplying the anode potential includes, in addition to the transformer and the voltage multiplier, an integrated oscillator circuit 52, with means including diode 53 and condenser 54 for applying a suitable d.c. voltage thereto; the oscillations produced, at a suitable frequency of about 10 kilohertz, are transmitted to the transformer 42 via the transistor 55. A slow start arrangement, including condenser 56 and resistor 57, is associated with the oscillator for preventing the application of the high potential to the anode before the cathode has attained its operating temperature. Feed-back to the oscillator from the voltage multiplier is provided via resistor 58. The use of the oscillator in this manner enables a transformer of small size to be employed for obtaining the desired step-up ratio.

This circuit arrangement provides a safety factor in the operation of the lamp, in that the cathode is so connected that if the cathode circuit is broken there is no current supply to the oscillator, and hence no high potential can be applied to the anode.

I claim:

1. A cathodoluminescent light source consisting of an electric lamp which includes an evacuated bulbous glass envelope with an integral glass neck terminated by a cap, an anode constituted by an electrically conductive coating on at least part of the interior surface of the bulb wall, such that at least part of the bulb wall is light transmissive, a layer of phosphor on the whole of the interior of the bulb wall and overlying the said anode coating, which phosphor is excitable to luminescence by electron bombardment, a dome-shaped metal mesh grid located within the bulb adjacent to the junction between the bulb and neck of the envelope, and supported by a hollow metal cylinder disposed coaxially within the envelope neck, an electron emissive cathode mounted within the assembly of the grid and its supporting cylinder, which cathode is so shaped and so located within the said grid assembly that the electrons emitted from the cathode in operation of the lamp are substantially uniformly distributed over the whole of the surface of the grid on which they impinge, and electrically conducting leads connecting said anode, grid and cathode to respective contacts, the grid and cathode contacts being carried by the said cap and the anode contact being located on the exterior of the envelope neck, which contacts are adapted to be connected to a circuit arrangement for operation of the lamp from a source of electric current supply.

2. A lamp according to claim 1, wherein the said cathode is a directly heated filament consisting of a refractory metal wire coil of wreath form incorporating electron emissive material, the coil being located coaxially within the grid assembly in the region of the junction between the grid and its supporting cylinder.

3. A lamp according to claim 1, wherein the said cathode is of the indirectly heated type, consisting of a hollow metal cylinder capped with a metal disc coated externally with electron emissive material, with a heating coil located within and insulated from the cylinder, the said disc being located coaxially within the grid assembly in the region of the junction between the grid and its supporting cylinder.

4. A lamp according to claim 1, wherein the said cathode consists of a linear refractory metal wire coil filament incorporating electron emissive material, is disposed orthogonally to the longitudinal axis of the said grid assembly, and is located within the grid supporting cylinder in a position nearer to the open end of the cylinder remote from the grid than to the end of said cylinder on which the grid is supported.

5. A lamp according to claim 4, wherein a metal disc of substantially the same diameter as the grid supporting cylinder is disposed coaxially with the said cylinder and is located adjacent to, but out of contact with, the open end of the said cylinder remote from the grid, and is connected to that lead to the cathode to which a negative potential will be applied in operation of the lamp, the said disc having a central aperture permitting the passage therethrough of the leads to the cathode.

6. A lamp according to claim 1, wherein the said anode coating covers the whole of the interior surface of the bulb wall and consists wholly of a light transmissive electrically conducting material.

7. A lamp according to claim 1, wherein at least part of the anode is constituted by an internally reflective metal coating on part of the interior surface of the bulb wall.

8. An electric lighting arrangement consisting of, in combination, a lamp according to claim 1 and a circuit arrangement for operating said lamp from a source of electric current supply, wherein the said circuit arrangement includes means for converting the supply voltage to unidirectional operating potentials for application to the anode, grid, and cathode of the lamp, and for applying unidirectional potentials of, respectively, 5 to 15 kilovolts to the anode, 40 to 250 volts to the grid, and 6 to 40 volts to the cathode, the cathode potential being negative with respect to the grid potential.

9. An electric lighting arrangement according to claim 8, wherein the said circuit arrangement is contained within a housing which is detachably mounted on the lamp cap and is insertable into a lampholder, the said housing being provided with contacts arranged to co-operate with the contacts on the lamp.

10. An electric lighting arrangement according to claim 8, wherein the said circuit arrangement is incorporated in a lampholder which is provided with contacts arranged to co-operate with the contacts on the lamp.

* * * * *